US008474944B2

(12) United States Patent
Zarmi

(10) Patent No.: US 8,474,944 B2
(45) Date of Patent: Jul. 2, 2013

(54) MATCHING IMAGING DATA TO FLEXOGRAPHIC PLATE SURFACE

(75) Inventor: Nir Zarmi, Moshav Be'erotaim (IL)

(73) Assignee: Eastman Kodak Company, Rochester, NY (US)

( * ) Notice: Subject to any disclaimer, the term of this patent is extended or adjusted under 35 U.S.C. 154(b) by 224 days.

(21) Appl. No.: 12/968,381

(22) Filed: Dec. 15, 2010

(65) Prior Publication Data

US 2012/0154796 A1 Jun. 21, 2012

(51) Int. Cl.
*B41J 29/393* (2006.01)

(52) U.S. Cl.
USPC ..... 347/19; 347/37

(58) Field of Classification Search
USPC ..... 347/19, 37
See application file for complete search history.

(56) References Cited

U.S. PATENT DOCUMENTS

| | | | | |
|---|---|---|---|---|
| 4,144,812 | A | 3/1979 | Julian | |
| 4,272,608 | A | 6/1981 | Proskow | |
| 5,252,432 | A | 10/1993 | Bach et al. | |
| 5,798,202 | A | 8/1998 | Cushner | |
| 7,914,104 | B2 * | 3/2011 | Silverbrook | 347/19 |
| 2006/0109294 | A1 * | 5/2006 | Garcia-Reyero et al. | 347/15 |

* cited by examiner

*Primary Examiner* — Lamson Nguyen
(74) *Attorney, Agent, or Firm* — Nelson Adrian Blish

(57) ABSTRACT

An imaging apparatus for forming an image on a flexible media includes a carriage which moves relative to the flexible media. An optical displacement sensor (ODS) is mounted on the carriage for scanning a surface of the flexible media to form scanned data wherein the scanned data represents the surface of the flexible media. A digital front end is adapted to analyze the scanned data to detect and locate defects on the flexible media. An imaging head mounted on the carriage for writing an image on the flexible media wherein the location of imaging on the flexible media is adjusted to avoid the location of the defects detected on the flexible media.

5 Claims, 11 Drawing Sheets

MATCHING IMAGING DATA TO FLEXOGRAPHIC PLATE SURFACE

CROSS REFERENCE TO RELATED APPLICATIONS

Reference is made to commonly-assigned copending U.S. patent application Ser. No. 12/968,387 (now U.S. Publication No. 2012/0152137), filed Dec. 15, 2010, entitled MATCHING IMAGING DATA TO FLEXOGRAPHIC PLATE SURFACE, by Tauger et al.; and U.S. patent application Ser. No. 12/779,131 (now U.S. Publication No. 2011/0278268), filed May 13, 2010, entitled WRITING AN IMAGE ON FLEXOGRAPHIC MEDIA, by Siman-Tov et al.; the disclosures of which are incorporated herein.

FIELD OF THE INVENTION

The present invention relates to methods and apparatus for matching the rendered image to be imaged on a flexographic plate to the structure of the flexographic plate.

BACKGROUND OF THE INVENTION

Flexographic printing involves inking a raised image which then comes in contact with the print substrate, for instance paper or plastic, and the transfer of ink from the raised image onto the print substrate. The plate is made of a rubbery material which has a somewhat pliant nature, the extent of which depends on the smoothness and fragility of the substrate. In contrast to other print processes such as offset lithography and gravure where high pressure is used during ink transfer, it is generally desirable to have a minimum of pressure between the raised inked image on the plate and the substrate. Too little pressure and no ink transfer or very uneven ink transfer will occur. Too much pressure and the pliant surface of the plate will be squashed into the substrate causing blurring of the image edges resulting in poor print quality.

Because of the requirement to work at minimal pressure for optimum quality, the distance between the plate surface and the substrate must be the same over the entire surface. This may depend on the uniformity of the press cylinder on which the plate is mounted and on the plate thickness uniformity. In the book Flexography Principles and Practices (Fourth Edition, page 109) accuracies of plus or minus 0.0005 inches are needed for the printing plates.

For some years the dominant type of flexographic plates has been based on mixtures of elastomeric material, photosensitive monomers and photoinitiators. Such plates have been termed polymer plates and as such they are supplied to the customer as solid light-sensitive plate material. These plates are generally made to the above-mentioned tolerance. For instance, U.S. Pat. No. 4,272,608 (Proskow), describing the manufacture of such plates, states that they can be made by solvent casting or by extruding, calendaring, or pressing at an elevated temperature. A further development in plate technology was in the introduction of LAMS plates-laser ablated masks. A black layer is coated on the photopolymer plate and then ablated away in areas that will correspond to the print image. The plate is exposed to UV light and developed. However accurately the plate is made, there is some distortion due to solvent development. This problem was discussed in U.S. Pat. No. 5,252,432 (Bach et al.). Using suitable choice of photopolymers and developer liquids they were able to achieve a thickness tolerance after development of +/− less than 15 microns.

An alternative way of preparing flexographic plates and sleeves is by engraving with a laser by ablation. Such a process does not require solvent development and therefore changes of thickness from such a cause are eliminated. For sleeves, the flexographic rubber has to be applied to a sleeve shell. U.S. Pat. No. 4,144,812 (Julian) describes such a process and grinding to obtain uniformity of thickness required. Such a method of grinding, however, was discussed in U.S. Pat. No. 5,798,202 (Cushner) as being time consuming and labour intensive.

Flexographic printing has increased applications in high print quality products which had previously been dominated by gravure and litho printing. For instance, plate-making is much easier and quicker than gravure and the use of inks where the carrying media is evaporated for drying makes it more applicable to printing on polymer than offset litho. The roll-to-roll flexographic machine is simpler than any roll-to-roll offset press which would be needed to print for instance flexible packaging.

For higher quality flexographic printing the plate thickness uniformity becomes an even more important issue. An additional part of obtaining high quality flexo printing is to use a soft under-cushion. During printing this cushion provided the give which would otherwise be provided by the plate image surface which would then slightly distort. However, generally the cushion has an even wider thickness tolerance than the plate itself.

A challenge of all mass production is quality control. For instance, in the case of flexographic plate precursor sheets, mass production is done in a continuous manner and control of thickness must be monitored and adjusted to always be within the specification. There is always some possibility, however, that plate precursor material that will be outside the thickness specification, will escape notice, and reach the customer. Such defects may be visually undetectable and would only be seen once the plate is imaged during the printing process. While the manufacturer may accept responsibility for plate defects and replace any plates, they would be unlikely to recompense the customer for the cost of time, materials, and inconvenience involved. The only way the manufacturer could ensure that this does not happen would be to check each plate precursor in a way that would not be economically viable.

The present invention solves a recognised need to ensure that the customer can optimise plate quality so that they are not wasting time and money in imaging and printing inferior plates.

SUMMARY OF THE INVENTION

Briefly, according to one aspect of the present invention an imaging apparatus for forming an image on a flexible media includes a carriage which moves relative to the flexible media. An optical displacement sensor (ODS) is mounted on the carriage for scanning a surface of the flexible media to form scanned data wherein the scanned data represents the surface of the flexible media. A digital front end is adapted to analyze the scanned data to detect and locate defects on the flexible media. An imaging head mounted on the carriage for writing an image on the flexible media wherein the location of imaging on the flexible media is adjusted to avoid the location of the defects detected on the flexible media.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

In the following detailed description, numerous specific details are set forth in order to provide a thorough understanding of the disclosure. However, it will be understood by those skilled in the art that the teachings of the present disclosure may be practiced without these specific details. In other instances, well-known methods, procedures, components and circuits have not been described in detail so as not to obscure the teachings of the present disclosure.

While the present invention is described in connection with one of the embodiments, it will be understood that it is not intended to limit the invention to this embodiment. On the contrary, it is intended to cover alternatives, modifications, and equivalents as covered by the appended claims.

Figure 1:
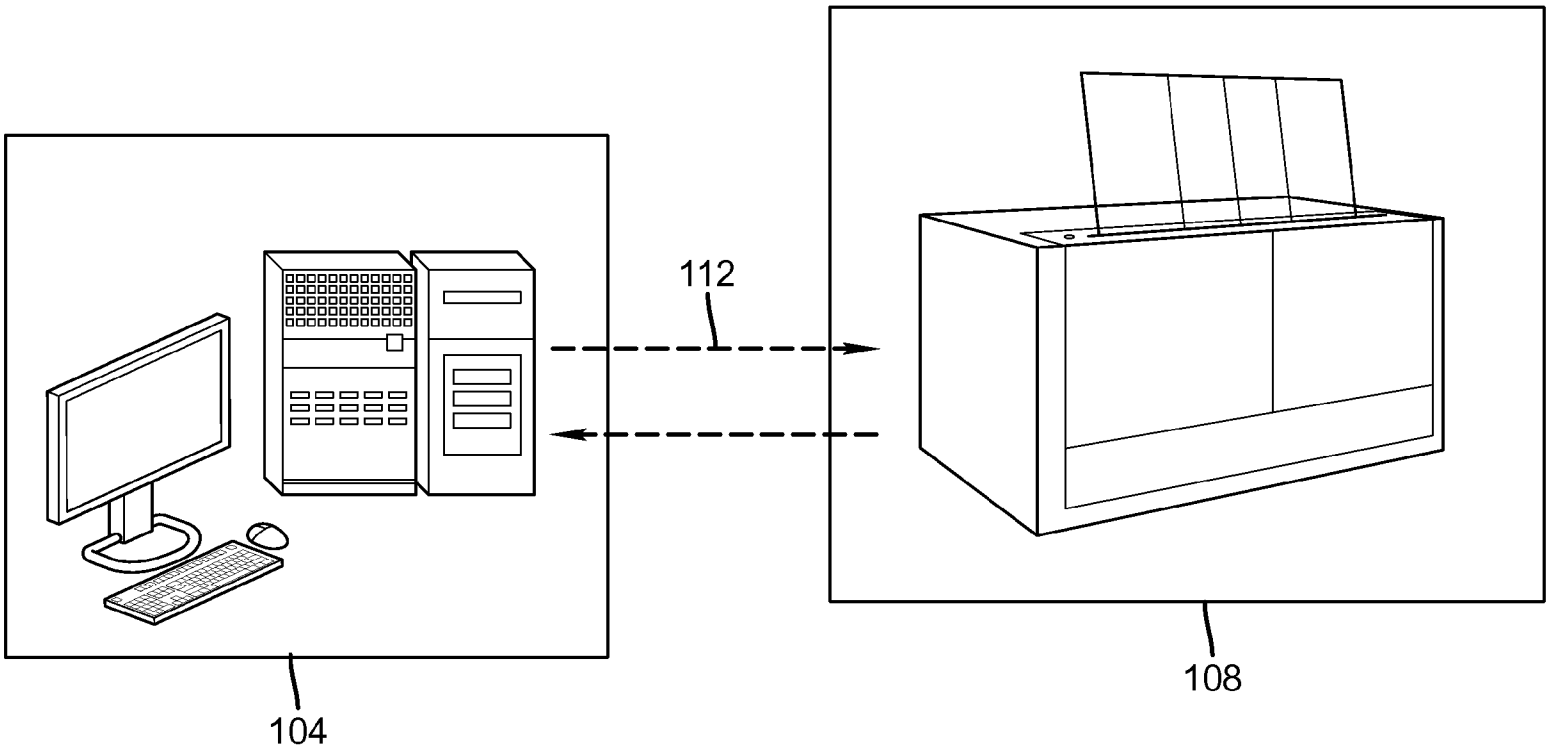
FIG. 1 represents in diagrammatic form of a digital front end driving an imaging device.

FIG. 1 shows a plate imaging device 108. The imaging device is driven by a digital front end (DFE) 104. The DFE receives printing jobs in a digital form from desktop publishing (DTP) systems (not shown), and renders the digital information for imaging. The rendered information and imaging device control data are communicated between DFE 104 and imaging device 108 over interface line 112.

Figure 2:
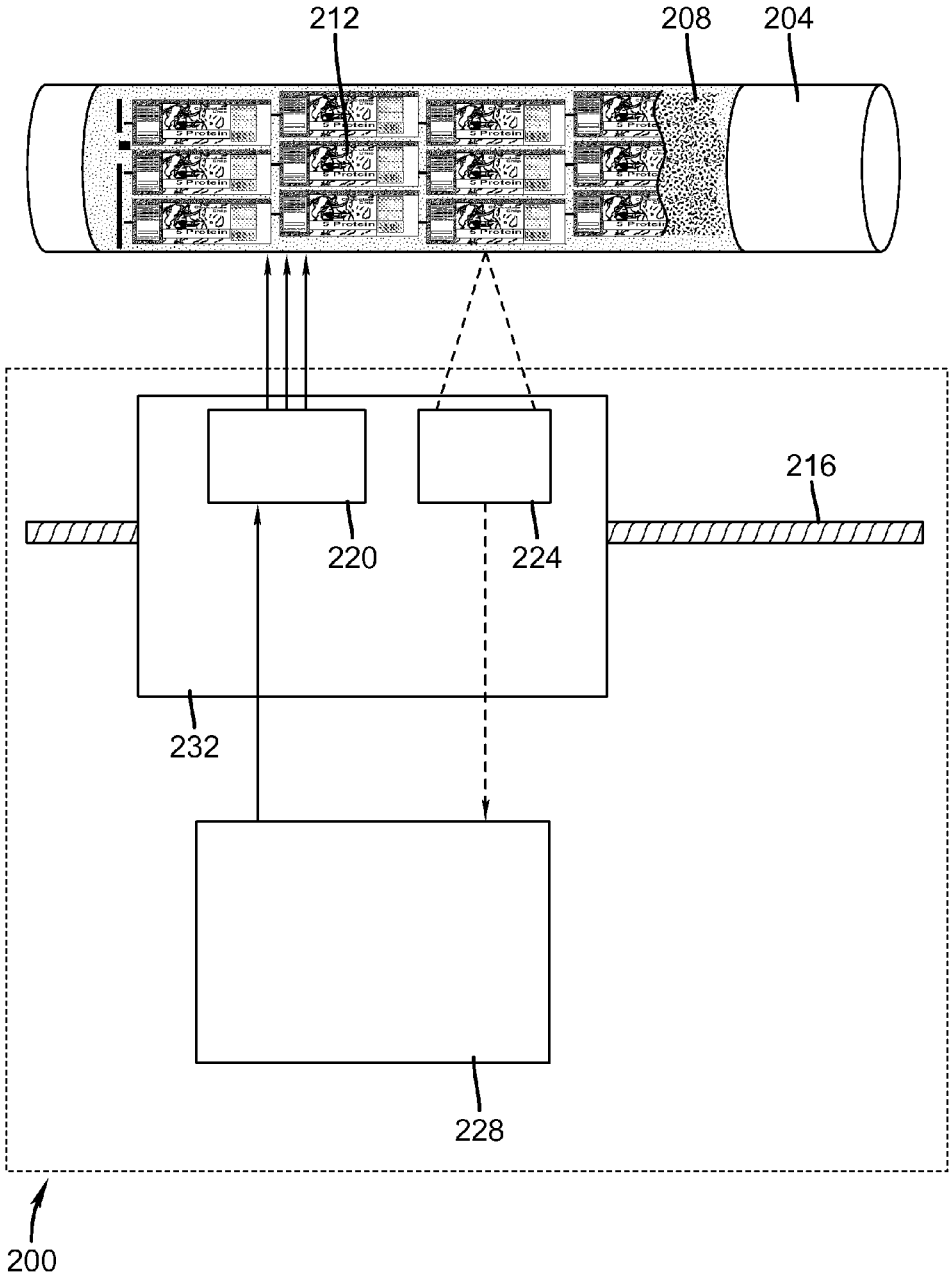
FIG. 2 represents in diagrammatic form the optical displacement sensor (ODS) together with the laser imaging head situated on the imaging carriage imaging on a plate mounted on an imaging cylinder.

FIG. 2 shows an imaging system 200. The imaging system 200 includes an imaging carriage 232 on which an optical displacement sensor (ODS) 224 is mounted along with an imaging head 220, the ODS 224 and imaging head 220 are controlled by controller 228. The ODS 224 is positioned in such a manner that it precedes the imaging during scanning. The imaging head 220 is configured to image on a flexographic plate 208 mounted on a rotating cylinder 204. The carriage 232 is adapted to move substantially in parallel to cylinder 204 guided by an advancement screw 216. The flexographic plate 208 is imaged by imaging head 220 to form an imaged data on flexographic plate 212 on plate 208.

Figure 3:
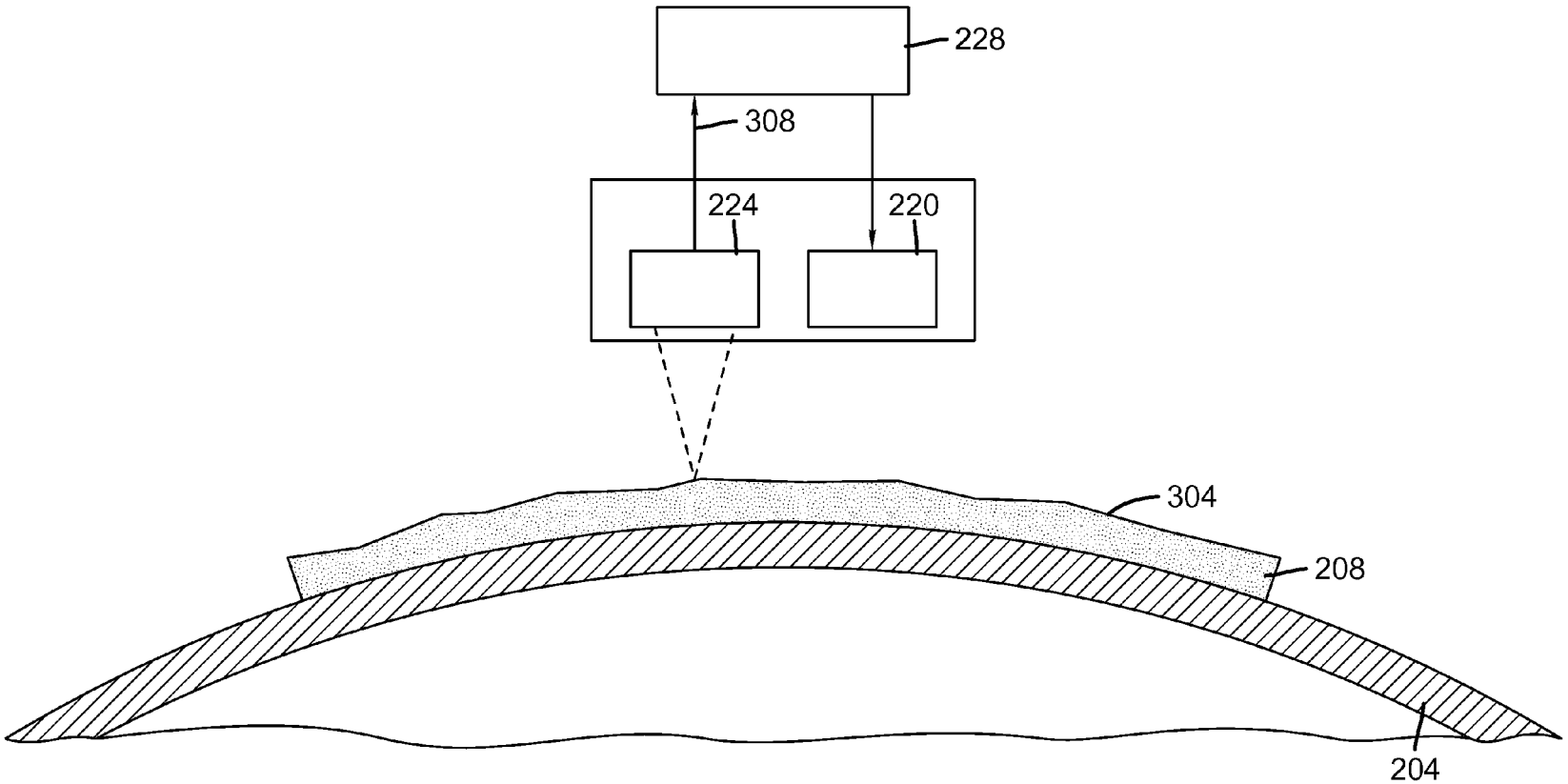
FIG. 3 represents in diagrammatic form the ODS scanning process of a plate secured to the imaging cylinder.

FIG. 3 shows an embodiment wherein the first stage of the imaging process is to scan the flexographic plate 208 with the ODS 224 in order to measure the structure of plate surface 304. The ODS 224 is shown scanning the un-imaged flexographic plate 208 with the imaging head 220 inactive (imaging is not performed), producing scanned data 308 of the flexographic plate 208. Scanned data 308 is communicated to DFE 104 for data analysis.

Figure 4:
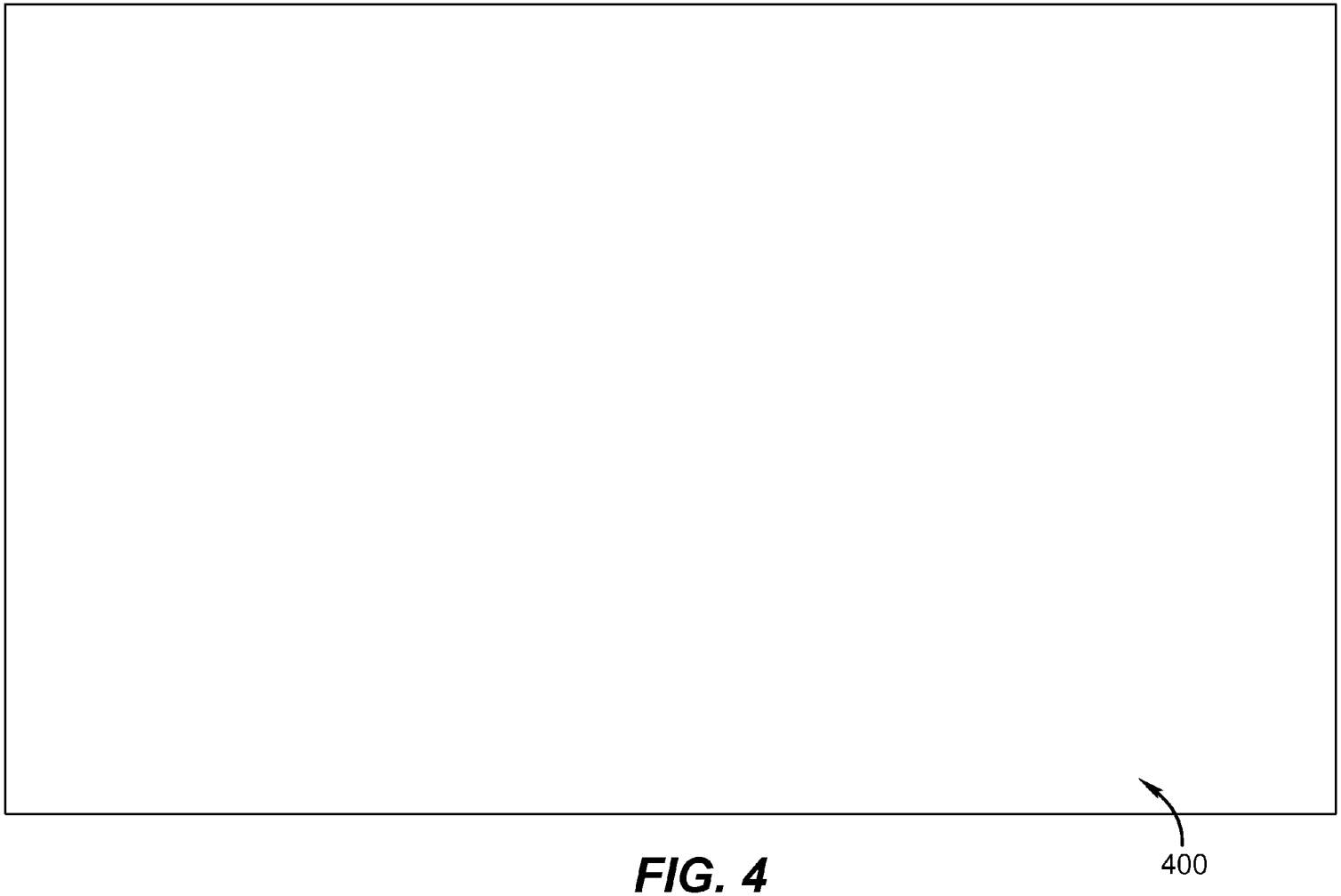
FIG. 4 represents in diagrammatic form an expanded flexographic plate.
Figure 5:
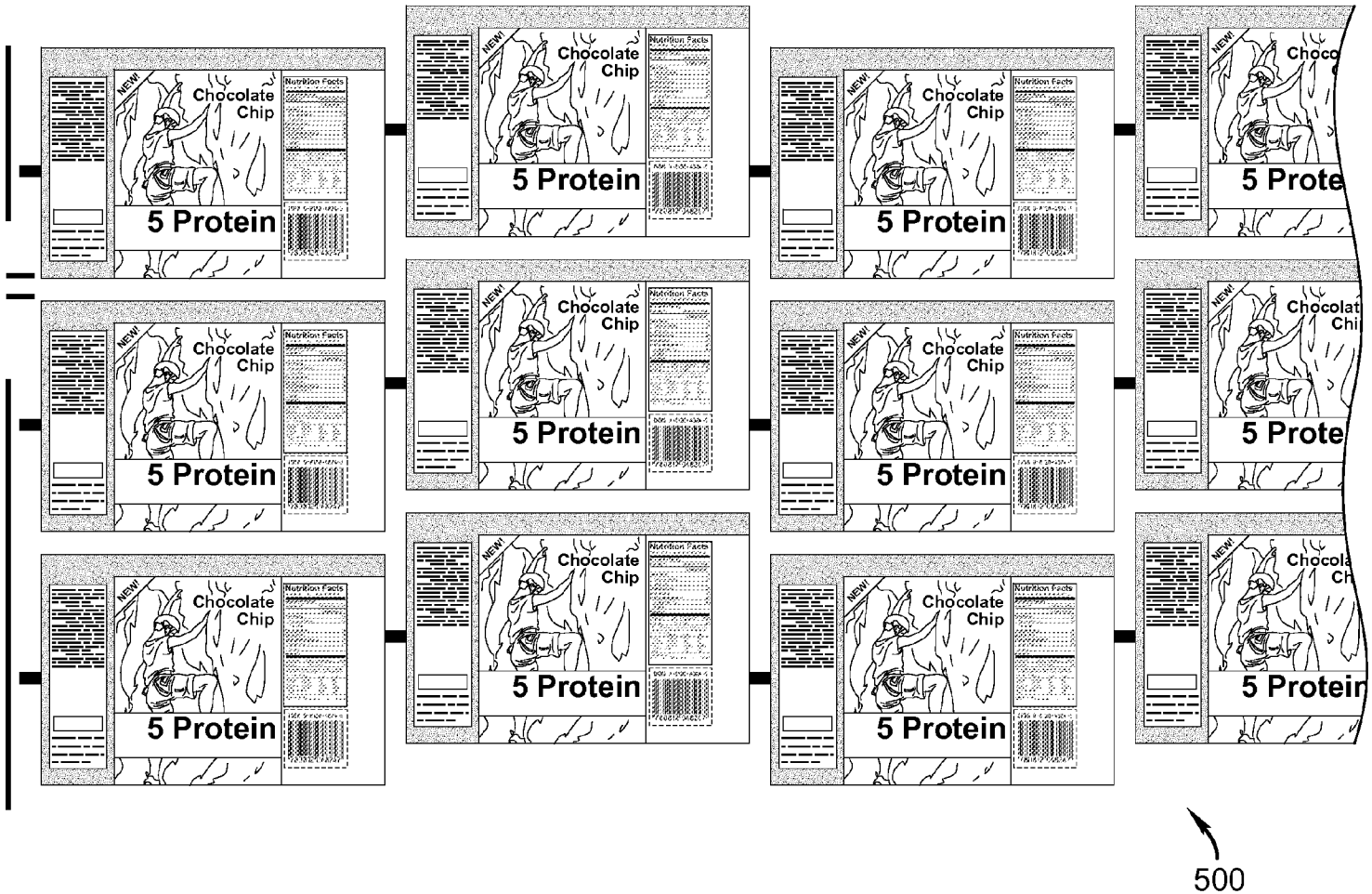
FIG. 5 represents in diagrammatic form a rendered image to be exposed on a flexographic plate.
Figure 6:
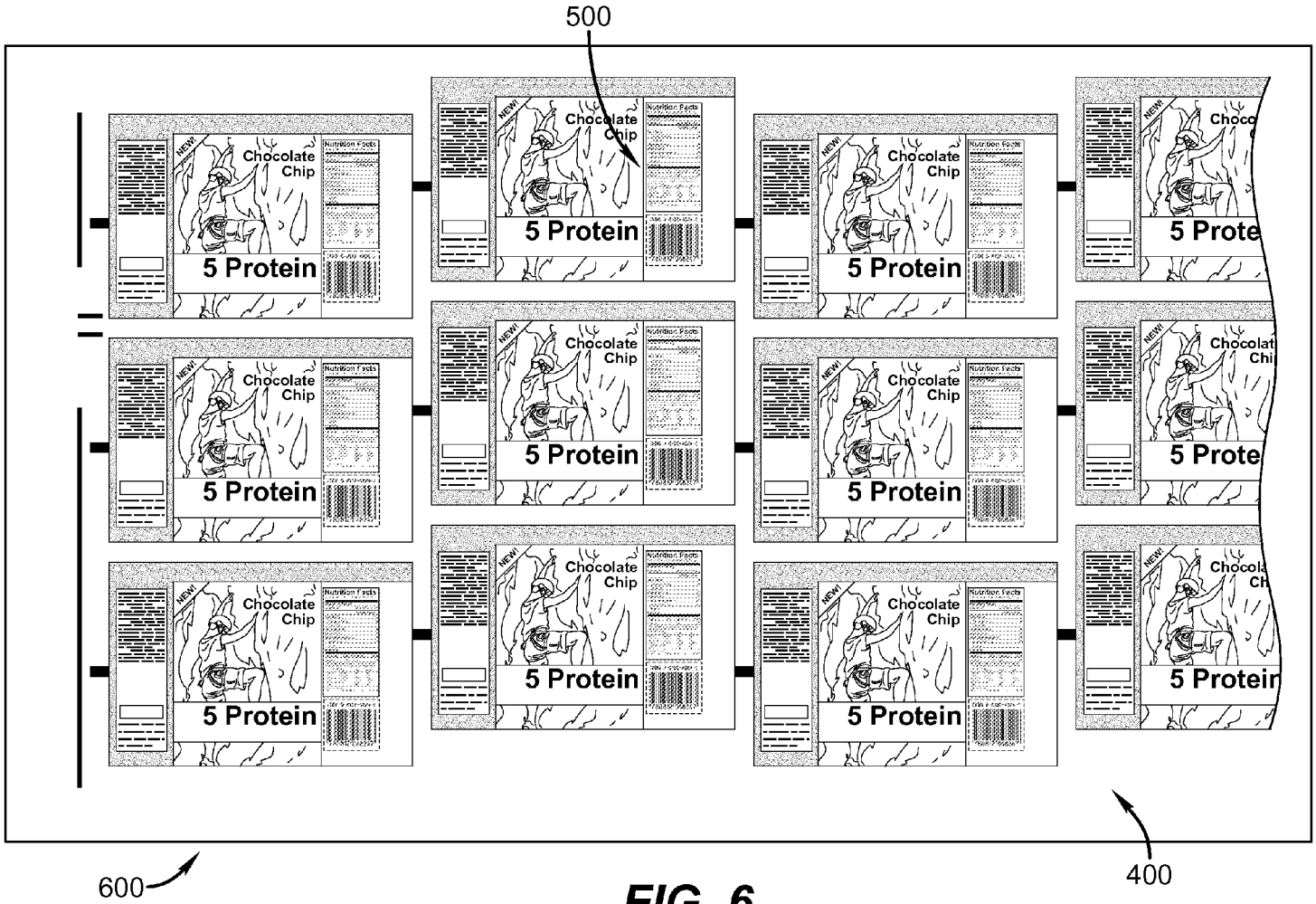
FIG. 6 represents in diagrammatic form a rendered image exposed on a flexographic plate.

FIG. 4 shows an expanded representation of a flexographic plate 400, without any defects on the plate, such a case is obviously rare, it is presented just for illustration. FIG. 5 shows a rendered image to be imaged on a plate 500, rendered image 500 was prepared by DFE 104, to be further imaged on the flexographic plate 208. FIG. 6 shows rendered image 500 imaged by imaging head 220 flexographic plate 208 to form an imaged plate 600.

Figure 7:
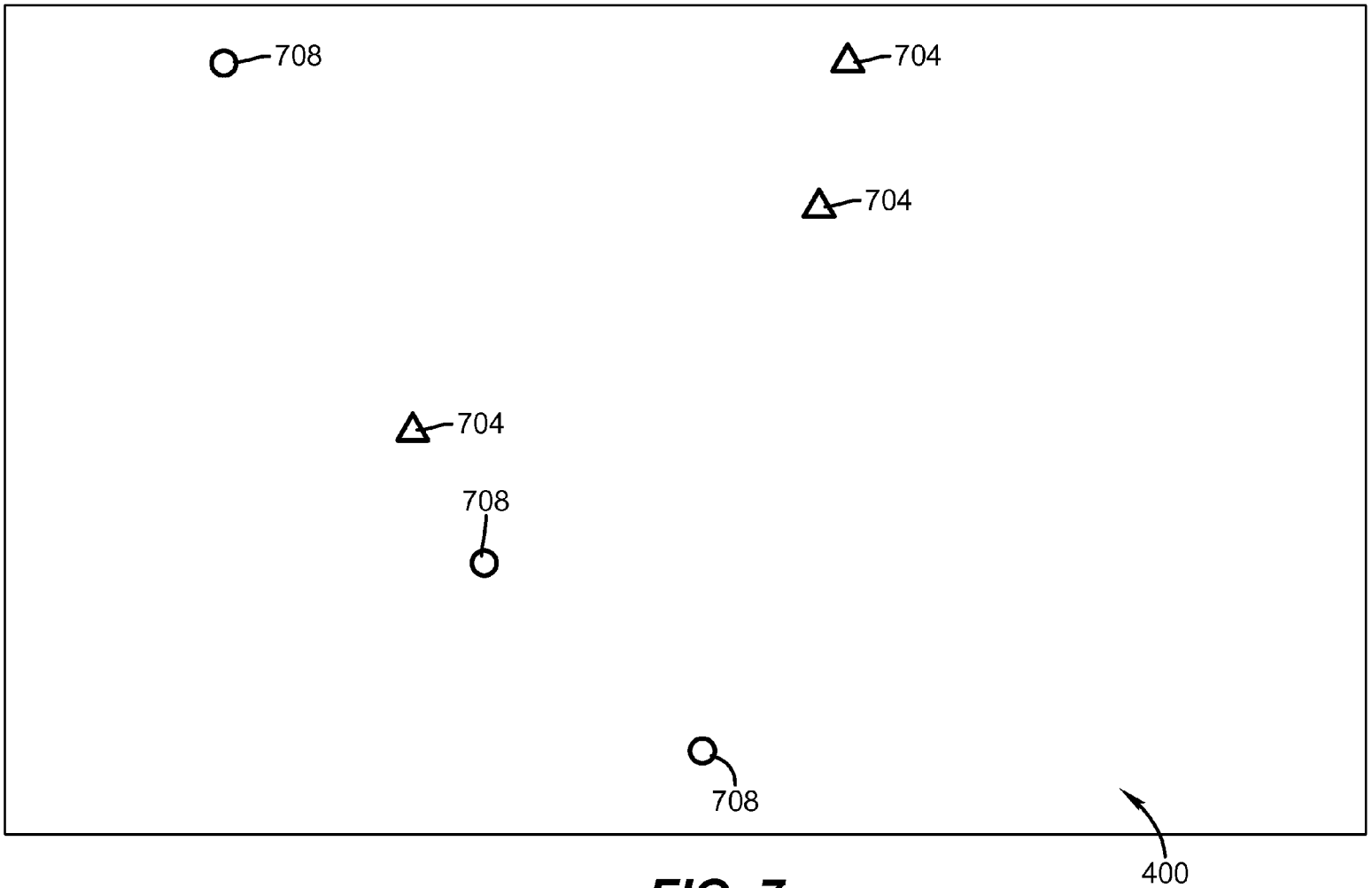
FIG. 7 represents in diagrammatic form an expanded flexographic plate showing defects found on plate.

FIG. 7 shows an expanded view of flexographic plate 208, with marked defects types 704 and 708. Defects type 704 represent removed plate spots, which will not print on the press. Defects of type 708 represent elevated spots on plate, which will show in printing. The defects were found by DFE 104 after analyzing the scanned data 308 obtained by ODS 224. The scanned data 308 is received after scanning surface 304 of flexographic plate 208. Defect 708*a* (from type 708) shows a spot on the plate where an image is planned to be printed.

Figure 8:
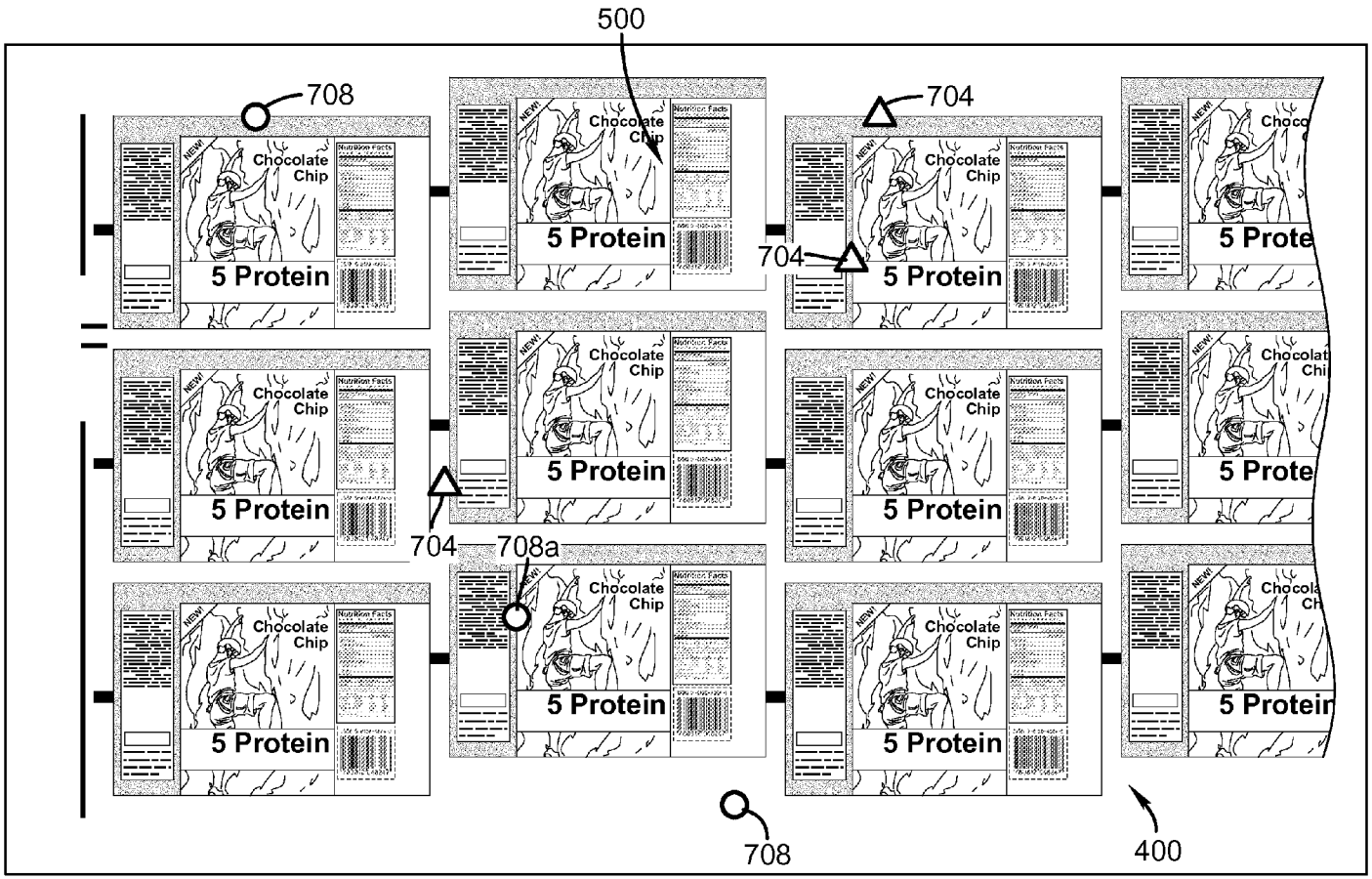
FIG. 8 represents in diagrammatic form a rendered image exposed on a flexographic plate wherein plate defects are shown in the exposed imaged areas.

FIG. 8 depicts an imaged plate 600, showing a rendered image 500 imaged on plate 400. The imaging is done also on some of the previously detected defects, as is shown in FIG. 7.

Figure 9:
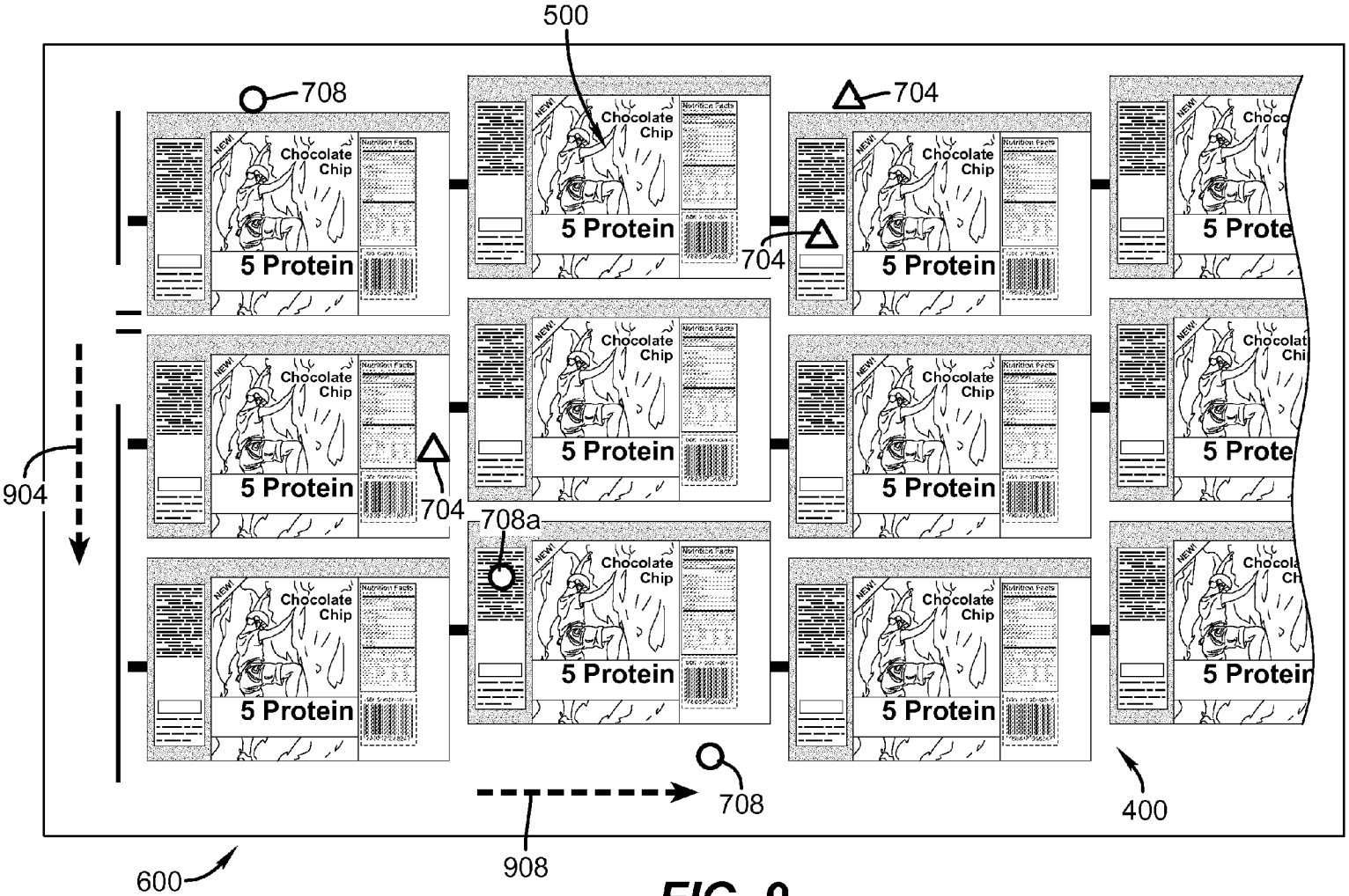
FIG. 9 represents in diagrammatic form a rendered image exposed on a flexographic plate wherein the image exposure parameters were adjusted to avoid the plate defects previously detected by the optical displacement scanner (ODS)

FIG. 9 shows a similar representation as is shown in FIG. 8, where by adjusting the exposure location of image 500 on plate 400, defects of type 704 and 708 will not affect the print quality. The image 500 is adjusted downwards in the Y direction 904 and rightwards in the X direction 908, thus not rejecting the usage of plate 400 for imaging; even thought defects were detected on the plate. Defect 708*a* (from type 708) shows a spot on the plate where an image is planned to be printed. Type 708 represents an elevated spot on plate 400; in this case 708*a* defect can be removed by polishing the spot where 708*a* is found with the imaging head 220, as is suggested by commonly-assigned copending U.S. patent application Ser. No. 12/779,131.

Figure 10:
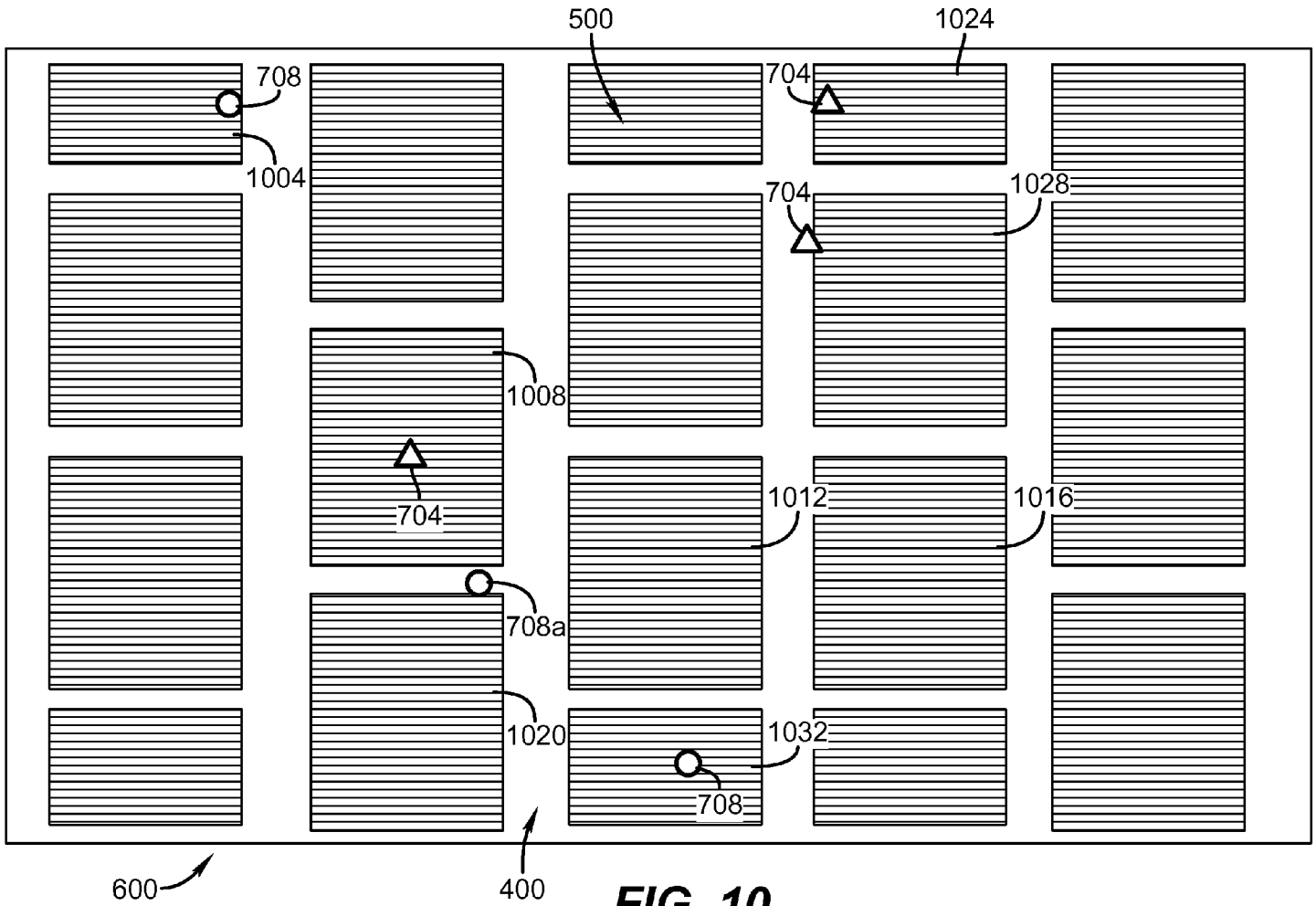
FIG. 10 represents in diagrammatic form of a rendered image exposed on a flexographic plate where plate defects are shown in the exposed imaged areas.
Figure 11:
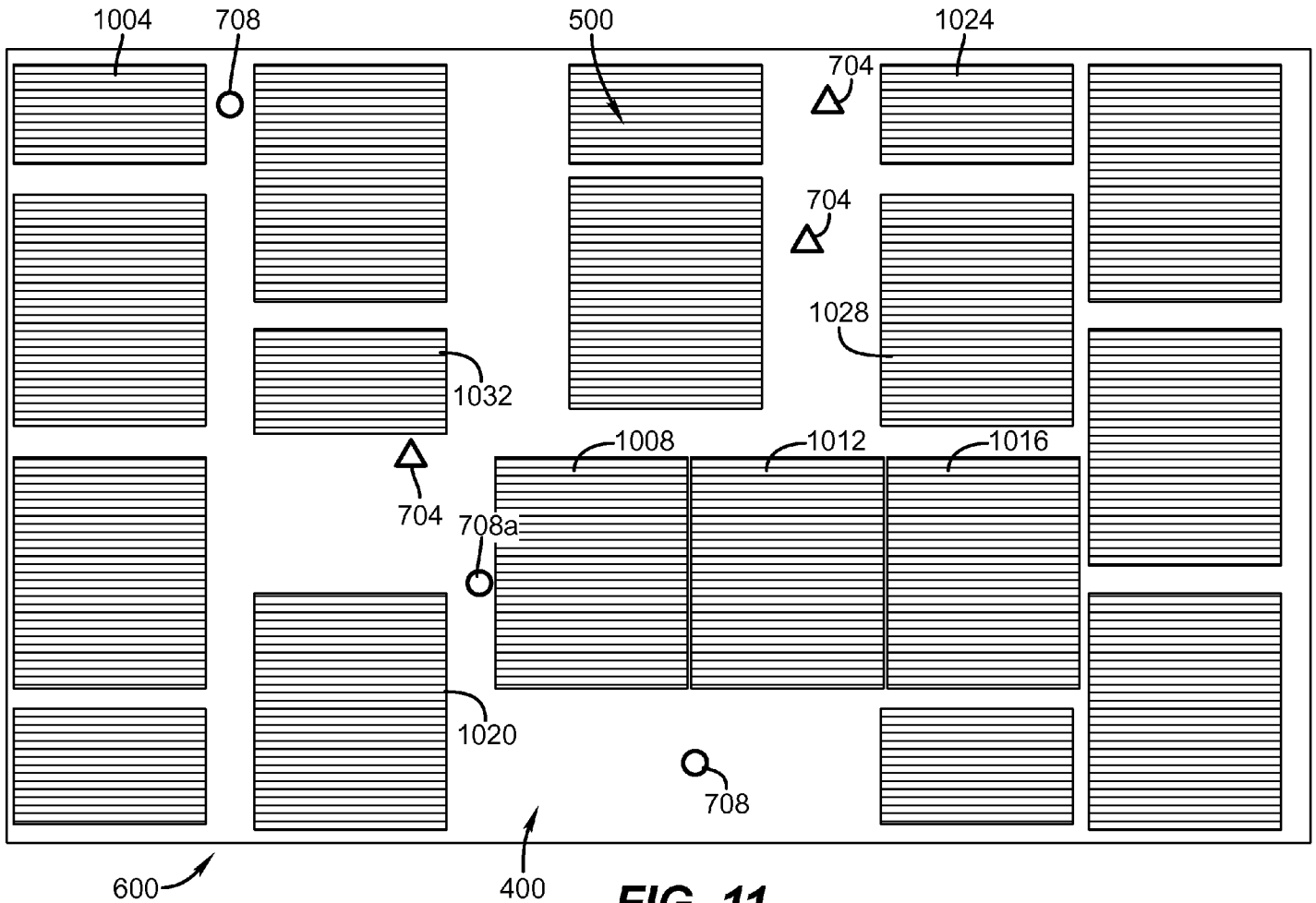
FIG. 11 represents in diagrammatic form a rendered image exposed on a flexographic plate where the layout of the printing job was adjusted to avoid the plate defects previously detected by the optical displacement scanner (ODS).

FIG. 10 shows a schematic representation of a rendered image 500 including plurality of image elements such as 1004. The layout of the elements in FIG. 10 when imaged on plate 400 will cause elements such as 1004, 1020, and 1032 fall on defects of type 708, and elements 1024, 1028, and 1008 fall on defect type 704. In this case the layout of the printing job can be changed to avoid imaging on areas where defects were found. FIG. 11 shows the position of elements 1004, 1008, 1012, 1016, 1020, 1020, 1024, 1028, and 1032 was rearranged by changing the layout of the printing job, thus avoiding from imaging on the defective spots (704, 708, and 708*a*) of plate 400.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

PARTS LIST

104 digital front end (DFE)
108 imaging device
112 interface line
200 imaging system
204 rotating cylinder
208 flexographic plate
212 imaged data on flexographic plate
216 screw
220 imaging head
224 optical displacement sensor (ODS)
228 controller
232 carriage
304 plate surface
308 scanned data
400 expanded view of a flexographic plate 208
500 rendered image to be imaged on a plate
600 rendered image imaged on a plate
704 plate defect on a non image able area (removed)
708 plate defect on an image able area (elevated)
708*a* 708 defect placed on an area to contain an imaged spot
904 Y axis offset adjustment
908 X axis offset adjustment
1004 image element
1008 image element
1012 image element
1016 image element
1020 image element
1024 image element
1028 image element
1032 image element

The invention claimed is:

1. An imaging apparatus for forming an image on a flexible media comprising:

a carriage which moves relative to said flexible media;

an optical displacement sensor (ODS) mounted on said carriage for scanning a surface of said flexible media to form scanned data wherein said scanned data represents the surface of said flexible media;

a digital front end adapted to analyze said scanned data to detect and locate defects on said flexible media; and an imaging head mounted on said carriage for writing an image on said flexible media wherein said image comprising plurality of imaging elements and wherein image data provided to said imaging elements is adjusted to avoid writing said image elements on areas on said flexible media having said defects.

2. The apparatus according to claim 1 wherein said flexible media is a flexographic sleeve.

3. The apparatus according to claim 1 wherein said flexible media is a flexographic plate.

4. The apparatus according to claim 1 wherein said flexible media is mounted on a cylindrical drum.

5. The apparatus according to claim 1 wherein said ODS scans the entire surface of said flexible media prior to writing an image.

* * * * *